US006471342B1

(12) United States Patent
Horio et al.

(10) Patent No.: US 6,471,342 B1
(45) Date of Patent: Oct. 29, 2002

(54) INK-JET HEAD

(75) Inventors: Hideaki Horio, Fukuoka (JP); Yutaka Miyazono, Fukuoka (JP); Koji Ikeda, Hyogo (JP); Akira Fukano, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/385,016

(22) Filed: Aug. 30, 1999

(30) Foreign Application Priority Data

Sep. 4, 1998 (JP) ..... 10-250875

(51) Int. Cl.[7] ..... B41J 2/045
(52) U.S. Cl. ..... 347/70; 347/71
(58) Field of Search ..... 347/70, 68, 54, 347/20, 71, 40, 27, 48, 50, 55, 72

(56) References Cited

U.S. PATENT DOCUMENTS

| | | | | | |
|---|---|---|---|---|---|
| 4,455,560 | A | * | 6/1984 | Louzil | 347/71 |
| 4,698,644 | A | | 10/1987 | Drago et al. | 347/40 |
| 5,245,244 | A | * | 9/1993 | Takahashi et al. | 310/328 |
| 5,617,122 | A | * | 4/1997 | Numata et al. | 347/14 |
| 5,617,127 | A | * | 4/1997 | Takeuchi et al. | 347/71 |
| 5,719,607 | A | * | 2/1998 | Hasegawa et al. | 347/70 |
| 5,992,978 | A | * | 11/1999 | Fujii et al. | 347/54 |
| 6,070,972 | A | * | 6/2000 | Thiel | 347/71 |
| 6,113,221 | A | * | 9/2000 | Weber | 347/61 |
| 6,113,226 | A | * | 9/2000 | Usui et al. | 347/71 |
| 6,196,664 | B1 | * | 3/2001 | Kanda et al. | 347/46 |

FOREIGN PATENT DOCUMENTS

| | | | |
|---|---|---|---|
| JP | 63-112157 | 5/1988 | |
| JP | 01-234254 | 9/1989 | |
| JP | 04-279351 | 3/1991 | |
| JP | 05-261919 | 3/1992 | |
| JP | 04-327946 | 11/1992 | |
| JP | 07-195690 | 8/1995 | |
| JP | 07-276630 | 10/1995 | |
| JP | 9-234864 | 9/1997 | B41J/2/045 |
| JP | 10-138493 | 5/1998 | |

* cited by examiner

*Primary Examiner*—Hai Pham
(74) *Attorney, Agent, or Firm*—Nixon Peabody LLP; Donald R. Studebaker

(57) ABSTRACT

An ink jet head having a plate-like actuator 14 to be deformed by field induction distortion serving as a drive source, causing ink in at least one pressure chamber 12 to be discharged, each deformable portion of the actuator 14 having a thickness of several $\mu$m and having an oval section in a plan elevation. Such pressure chambers 12 are disposed in a plurality of columns. A group of electric contacts 37 is disposed outside of the outermost pressure-chamber column. Wiring lines of individual electrodes of the actuator 14 of the pressure chambers 12 pass between adjacent pressure chambers 12.

19 Claims, 7 Drawing Sheets

INK-JET HEAD

BACKGROUND OF THE INVENTION

1. Field of the Invention

The present invention relates to an ink jet head used in an ink jet printer.

2. Description of Prior Art

Japanese Patent Laid-Open Publication No. H9-234864 discloses an example of an ink jet head. This ink jet head has a plurality of pressure chambers to which ink is supplied. The pressure chambers have one faces made of a common diaphragm. Provision is made such that a piezoelectric element bents the diaphragm to reduce the corresponding pressure chamber in volume, causing the nozzle connected to this pressure chamber to discharge the ink. Put on the common diaphragm is a common reinforcing plate, on which the piezoelectric elements are placed. Each individual electrode (upper electrode) is formed on the obverse surface of each piezoelectric element, while a common electrode (lower electrode) is formed on the reverse surfaces of the piezoelectric elements.

Each of the pressure chambers has a slender rectangular section in a plan elevation. In this ink jet head, such slender rectangular pressure chambers are transversely arranged. In this ink jet head, a block forming the pressure chambers is connected to a block forming an ink reservoir and ink discharge nozzles.

In this ink jet head of prior art, when it is intended to increase each maximum ink discharge amount such that the ink discharge can be controlled with good gradation, this introduces the problems that each pressure chamber is accordingly increased in size, a high dot density cannot be achieved and the entire head is increased in size. It is to increase the dot density as high as possible that each pressure chambers is formed in a slender rectangular shape. When each pressure chamber is formed in a slender rectangular shape, however, there is required high positioning precision for connecting the block forming the pressure chambers, the block forming the ink passages and the block forming the ink discharge nozzles to one another. This results in lowered yield.

SUMMARY OF THE INVENTION

It is an object of the present invention to provide an ink jet head which is advantageous in ink discharge control with good gradation, high dot density and compact head design.

The present invention achieves this object by improving an ink jet head in various points such as the diaphragm thickness, the deformation amount, the diaphragm shape (the shape of each of the openings of pressure chambers covered by the diaphragm), the arrangement of the pressure chambers and the like.

In an ink jet head comprising: a head main body in which formed are a plurality of pressure-chamber concave portions having supply ports for supplying ink and discharge ports for discharging ink; and a plate-like actuator which covers the pressure-chamber concave portions of the head main body, which forms a plurality of pressure chambers together with the pressure-chamber concave portions, and portions covering the pressure-chamber concave portions of which is deformable by field induction distortion serving as a drive source, causing ink in at least one pressure chamber to be discharged, the ink jet head of the present invention is characterized in that the deformation amount of each deformable portion of the actuator is set such that the ratio A/V between the maximum discharge amount V (p1) of each pressure chamber and that area A ($\mu m^2$) of each deformable portion of the actuator which corresponds to the opening area of each pressure-chamber concave portion, is not greater than 10000.

The maximum discharge amount V refers to the maximum amount of ink to be discharged from each pressure chamber when each deformable portion of the actuator is bent and deformed one time toward the inside of each pressure chamber.

The ratio $A/V \leqq 10000$ means that a large amount of ink can be discharged even though each deformable portion of the actuator is small in area. This is advantageous in ink discharge control with good gradation. Further, the smaller area of each deformable portion is more advantageous in both high dot density and compact head design.

Preferably, the ratio A/V is in the range of 6000 to 10000.

To obtain a deformation amount such that the ratio A/V is not greater than 10000, it is preferable that each deformable portion of the actuator has a thickness of not greater than 8 $\mu m$ and is made in the form of an oval in which the ratio L/S of the shorter diameter S to the larger diameter L is in the range of 1 to 3. According to such an arrangement, a large deformation amount can be obtained even though each deformable portion of the actuator is reduced in area. This is more advantageous in ink discharge control with good gradation, high dot density and compact head design.

Preferably, each deformable portion of the actuator has a maximum thickness in the range of 2 to 8 $\mu m$.

Preferably, the actuator comprises: a diaphragm which covers the pressure-chamber concave portions of the head main body and which forms the pressure chambers together with the pressure-chamber concave portions; piezoelectric elements, each in the form of a thin film, respectively disposed for the pressure chambers and bonded to the diaphragm at the deformable portions thereof which form the pressure chambers, each piezoelectric elements being arranged to deform each deformable portion to discharge ink in each pressure chamber; and individual electrodes respectively disposed for the piezoelectric elements for applying a voltage thereto, each deformable portion of the diaphragm having a thickness of 1 to 5 $\mu m$.

A field induction distortion of a piezoelectric element bends and deforms that deformable portion of the diaphragm to which this piezoelectric element is bonded. This changes the corresponding pressure chamber in volume to cause ink therein to be discharged. Since each deformable portion of the diaphragm has a thickness of 1~5 $\mu m$, each deformable portion can be bent and deformed in a large amount as compared with its area.

In a ink jet head in which the pressure chambers are arranged in not less than three columns, it is preferable that a group of electric contacts for individual electrodes, of the actuator, respectively disposed for the pressure chambers, is disposed outside of the outermost pressure-chamber column out of the pressure-chamber columns, and that a plurality of conductors for connecting, to the corresponding contacts of the group of electric contacts, the individual electrodes for the pressure chambers in the columns inside of the outermost pressure-chamber column, pass between adjacent pressure chambers in the outermost pressure-chamber column, the conductors above-mentioned passing at the head surface side.

More specifically, when the pressure chambers are arranged in not less than three columns, the dot density can be increased. However, if the electric contacts of the individual electrodes are disposed in the vicinity of the pressure chambers, it is required to provide contact spaces around the pressure chambers. This prevents the pressure chambers from being densely arranged. As a result, a number of ink discharge holes are extensively dispersedly disposed, contributing to the increase of the ink jet head in size. Thus, according to the present invention, there are utilized, as the wiring spaces, the spaces opposite to the top end faces of partition walls which partition adjacent pressure chambers (the spaces at the head surface side). Accordingly, the electric contacts can be gathered outside of the outermost pressure-chamber column, thus facilitating the wiring of the electric contacts. Further, the pressure chambers can densely be disposed. This is advantageous in both high dot density and compact head design.

When the ink jet head is arranged such that the plurality of pressure chambers are arranged in a plurality of columns, and that the actuator comprises: a diaphragm which covers the pressure-chamber concave portions of the head main body and which forms the pressure chambers together with the pressure-chamber concave portions; piezoelectric elements, each in the form of a thin film, respectively disposed for the pressure chambers and bonded to the diaphragm at the deformable portions thereof which form the pressure chambers, each piezoelectric elements being arranged to deform each deformable portion to discharge ink in each pressure chamber; and individual electrodes respectively disposed for the piezoelectric elements for applying a voltage thereto, it is preferable that the piezoelectric elements and the individual electrode are formed, as overlapped each other in the same pattern, on the surface of the diaphragm, thereby to form drive portions and conductor portions, the drive portions being formed, at the deformable portions, for deforming the same, the conductor portions extending from the drive portions to the outside of the outermost pressure-chamber column out of the plurality of pressure-chamber columns, and the conductor portions which extend from the drive portions of the pressure chambers in the columns inside of the outermost pressure-chamber column, passing between adjacent pressure chambers in the outermost pressure-chamber column, these conductor portions passing at the head surface side.

More specifically, when those portions of the partition walls between adjacent pressure chambers which are opposite to the head surface side, are utilized as the wiring spaces, it can be considered to dispose, at these spaces, conductors through insulation layers and to overlappingly connect the conductors onto the piezoelectric elements in the pressure chambers. According to such an arrangement, however, differences in level are produced at such connection parts, readily contributing to disconnection. Such a phenomenon of disconnection is remarkable particularly when thin-film conductors are used. Further, such connection is generally difficult.

According to the present invention, the piezoelectric elements and the individual electrode are formed, as overlapped each other in the same pattern, on the surface of the diaphragm thereby to form the drive portions and the conductor portions, and the conductor portions which extend from the drive portions of the pressure chambers in the columns inside of the outermost pressure-chamber column, pass between adjacent pressure chambers in the outermost pressure-chamber column. This does not produce the differences in level above-mentioned, and is therefore advantageous in the avoidance of disconnection. Further, as to the pattern formation, there is adopted a method of simultaneously patterning a laminated body of material films for piezoelectric elements and individual electrodes. This is also advantageous in production.

In an ink jet head comprising: a head main body in which formed are a plurality of pressure-chamber concave portions having supply ports for supplying ink and discharge ports for discharging ink; and a plate-like actuator which covers the pressure-chamber concave portions of the head main body, which forms a plurality of pressure chambers together with the pressure-chamber concave portions, and portions covering the pressure-chamber concave portions of which is deformable by field induction distortion serving as a drive source, causing ink in at least one pressure chamber to be discharged, the ink jet head is preferably arranged to satisfy the three conditions that each of the deformable portions of the actuator which form the pressure chambers, has a thickness of not greater than 8 $\mu$m, that the plurality of pressure chambers are arranged in a plurality of columns of which number is in the range 6 to 10, and that at the time when the ink jet head makes one scan in a main scanning direction, the dot density in an auxiliary scanning direction at a right angle to the main scanning direction, is not less than 300 dpi.

More specifically, even though it is intended to arrange pressure chambers as many as possible in a space having a predetermined length, there is still a limit in the number of pressure chambers which can be arranged, because it is required to assure the volumes of the pressure chambers. Accordingly, to achieve a dot density of not less than 300 dpi, the pressure chambers are required to be arranged in a plurality of columns. However, as the number of pressure-chamber columns is increased, the head itself is increased in size. Thus, when the number of the pressure-chamber columns is set in the range of 6 to 10 and the thickness of each deformable portion of the actuator is minimized, a high dot density of not less than 300 dpi can be achieved with no increase of the head in size.

More specifically, even though the opening area of each pressure-chamber concave portion (the area of each deformable portion) is small, a necessary discharge amount can be assured by minimizing the thickness of each deformable portion of the actuator. Further, the number of pressure chambers to be arranged in each column can be increased by reducing the area of each deformable portion. For example, when the dot density is increased from 300 dpi to 600 dpi, it is required according to a simple calculation to arrange, in each column, pressure chambers in twice the number. However, when the dot density is doubled, the discharge amount of ink to be discharged from each pressure chamber can be reduced to ½ or less, or ¼ or less in certain cases, and the area of each deformable portion can therefore be reduced. Accordingly, the number of pressure chambers in each column can be increased and there is no need to excessively increase the number of pressure-chamber columns.

As to the three conditions above-mentioned, it is preferable that the actuator has a maximum thickness in the range of 2 to 8 $\mu$m, that the number of pressure-chamber columns is in the range 6 to 10, and that the dot density is in the range of 300 to 1200 dpi.

In the ink jet head satisfying the three conditions above-mentioned, the actuator preferably comprises: a diaphragm which covers the pressure-chamber concave portions of the head main body and which forms the pressure chambers together with the pressure-chamber concave portions; piezoelectric elements, each in the form of a thin film, respectively disposed for the pressure chambers and bonded to the diaphragm at the deformable portions thereof which form the pressure chambers, each piezoelectric elements being arranged to deform each deformable portion to discharge ink in each pressure chamber; and individual electrodes respectively disposed for the piezoelectric elements for applying a voltage thereto, and each deformable portion of the diaphragm preferably has a thickness of 1 to 5 $\mu$m.

Preferably, each deformable portion of the actuator is made in the form of an oval in which the ratio L/S of the shorter diameter to the larger diameter L, is in the range of 1 to 3.

More specifically, since each deformable portion of the actuator is in the form of an oval, a necessary ink discharge amount can be assured even though each deformable portion is small in area. Further, this is in advantageous in achievement of dot density of not less than 300 dpi with the column number of 6 to 10. Further, the fact that each deformable portion is made in the form of an oval in which the ratio L/S is in the range of 1 to 3, means that, even though the number of pressure-chamber columns is increased, the pressure chambers are not extensively dispersed in the main scanning direction. Accordingly, even though the nozzles (ink discharge ports) are formed immediately below the pressure chambers, the nozzle distances in the main scanning direction are not increased. This not only facilitates a signal processing for selectively discharging ink from nozzles, but also is advantageous in compact head design.

Preferably, the pressure chambers are arranged in zigzags such that the pressure chambers in each column are disposed at positions corresponding to the positions between the adjacent pressure chambers in each of adjacent column.

More specifically, the zigzag arrangement of pressure chambers enables the pressure chambers to be densely arranged and is therefore advantageous in compact head design.

In the ink jet head satisfying the three conditions abovementioned, it is preferable that the ratio A/V between the maximum discharge amount V (p1) of each pressure chamber and that area A ($\mu m^2$) of each deformable port ion of the actuator which corresponds to the opening area of each pressure-chamber concave portion, is not greater than 10000.

More specifically, the ratio A/V of not greater than 10000 means that the ink discharge amount is large even though each deformable portion is small in area. This is advantageous not only in achievement of dot density of not less than 300 dpi with the column number of 6 to 10, but also in compact head design.

Preferably, the ratio A/V is in the range of 6000 to 10000.

DETAILED DESCRIPTION OF THE INVENTION

The following description will discuss an embodiment of the present invention with reference to the attached drawings.

Figure 1:
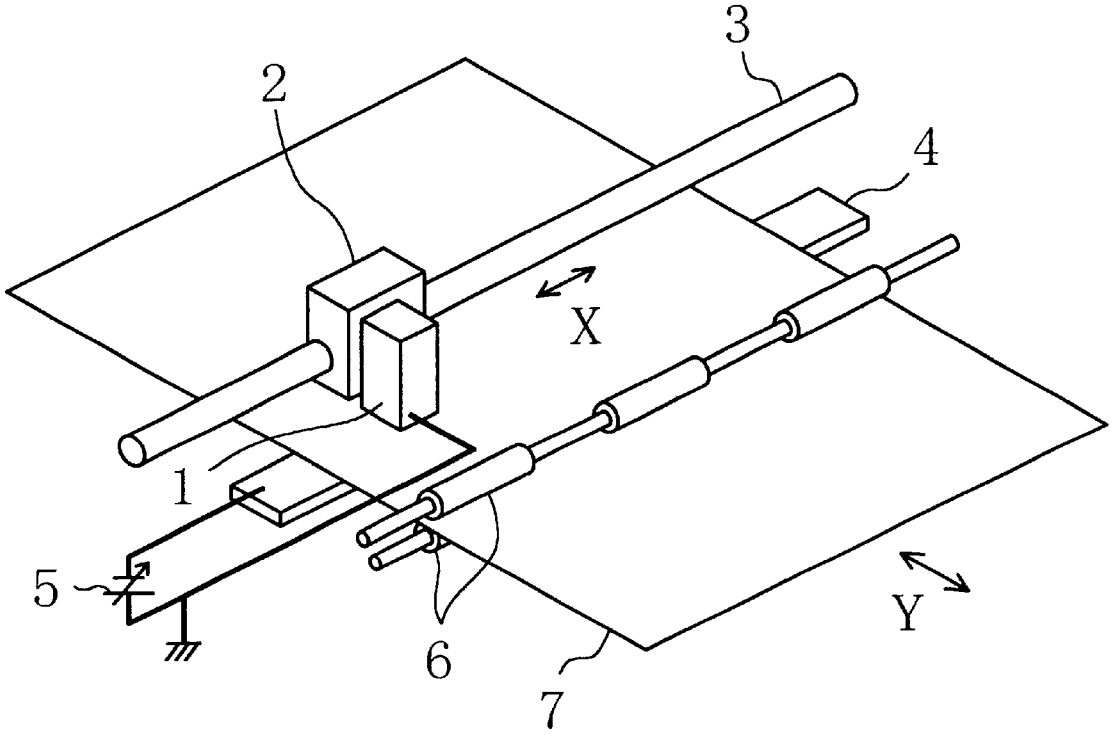
FIG. 1 is a perspective view of an ink jet printer to which applied is an ink jet head according to an embodiment of the present invention.

In an ink jet printer shown in FIG. 1, an ink jet head 1 is arranged to be reciprocated by drive means (not shown) while being guided by a carriage shaft 3 mounted on a carriage 2. The carriage 2 and the carriage shaft 3 form means for relatively moving the ink jet head I and recording paper 7 with respect to each other.

This relative moving direction X serves as a main scanning direction of the ink jet head 1.

An opposite electrode 4 is disposed opposite to the ink jet head 1. Provision is made such that a predetermined high voltage (for example −1.8 KV) is applied to the ink jet head 1 and the opposite electrode 4 by a power supply 5 with ink jet head 1 grounded. There is also disposed a recording paper delivery device 6 for delivering the recording paper 7 in the direction at a right angle to the carriage shaft 3. The recording paper 7 is delivered between the ink jet head 1 and the opposite electrode 4. This paper delivery direction Y serves as an auxiliary scanning direction at a right angle to the main scanning direction.

The high voltage is applied across the opposite electrode 4 and a nozzle plate, to be discussed later, of the ink jet head 1. This causes each ink drop discharged from the nozzle plate to be positively electrified. By the static electric field between the nozzle plate and the opposite electrode 4, each ink drop is discharged, as accelerated, onto the recording paper 7.

FIG. 2 to FIG. 7 show specific arrangements of the ink jet head 1. In the ink jet head 1 in FIG. 2, a head main body (substrate) 11 has a number of pressure chambers 12 for causing ink to be discharged, and an IC chip 13 is disposed for applying a voltage to piezoelectric elements of the pressure chambers 12. In this embodiment, a number of pressure chambers 12 are arranged in eight columns in the auxiliary scanning direction.

Figure 3:
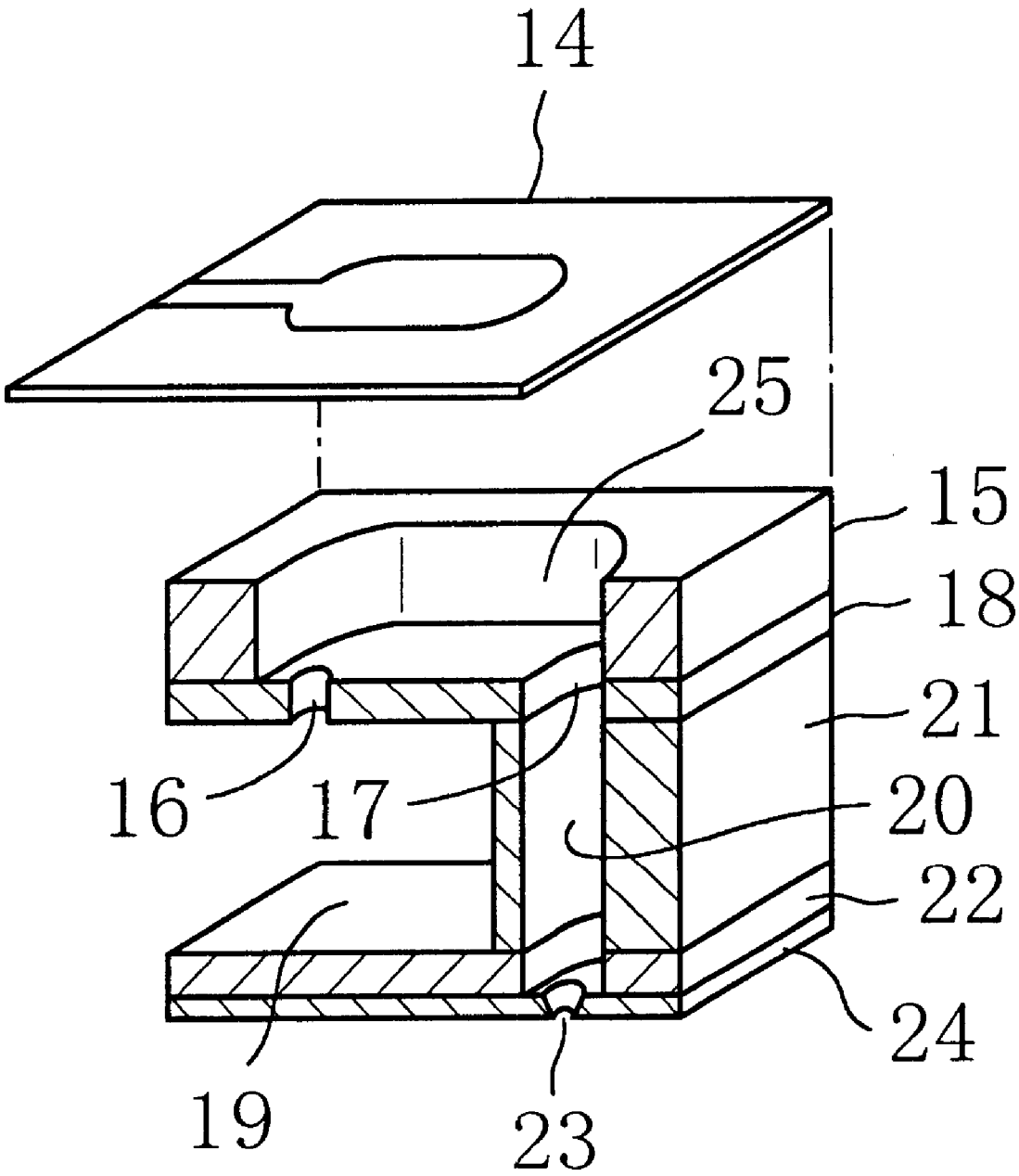
FIG. 3 is an exploded perspective view of portions of the head main body and an actuator of the ink jet head shown in FIG. 1.

As shown in FIG. 3, the head main body 11 comprises a first plate 15 having through-holes for forming the pressure chambers, a second plate 18 having ink supply ports 16 and ink discharge ports 17, third and fourth plates 21, 22 for forming ink supply passages 19 and ink discharge passages 20, and a fifth plate (nozzle plate) 24 having ink discharge holes 23, the first to fifth plates being vertically placed one upon another from the top to the bottom. More specifically, the first plate 15 and the second plate 18 form pressure-chamber concave portions 25 provided in the bottoms thereof with the ink supply ports. 16 and the ink discharge ports 17, and the second, third and fourth plates 18, 21, 22 form both the ink supply passages 19 communicating with the ink supply ports 16 and the ink discharge passages 20 communicating with the ink discharge ports 17. The ink discharge passages 20 communicate with the ink discharge holes 23 in the fifth plate 24. As covering the openings of the pressure-chamber concave portions 25, an actuator 14 is disposed on the first plate 15 to form the pressure chambers 12.

Figure 4:
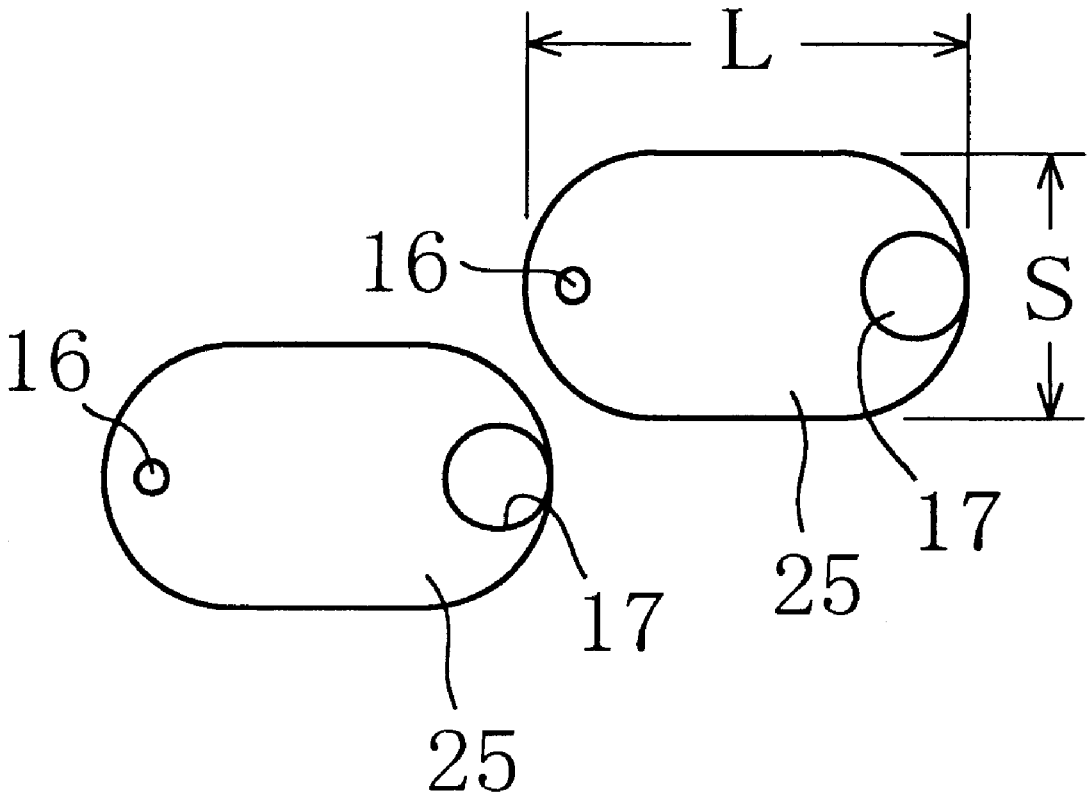
FIG. 4 is a plan view illustrating the shapes of the openings of pressure-chamber concave portions (the shapes of deformable portions of the actuator or the shapes of deformable portions of a diaphragm) of the ink jet head shown in FIG. 1.

FIG. 4 specifically shows the shapes of openings of pressure-chamber concave portions 25. Each of the openings is made in the form of an oval in which the ratio L/S of the shorter diameter S to the larger diameter L is in the range of 1 to 3. The pressure-chamber concave portions 25 are formed such that the larger diameters L extend in the main scanning direction.

Figure 5:
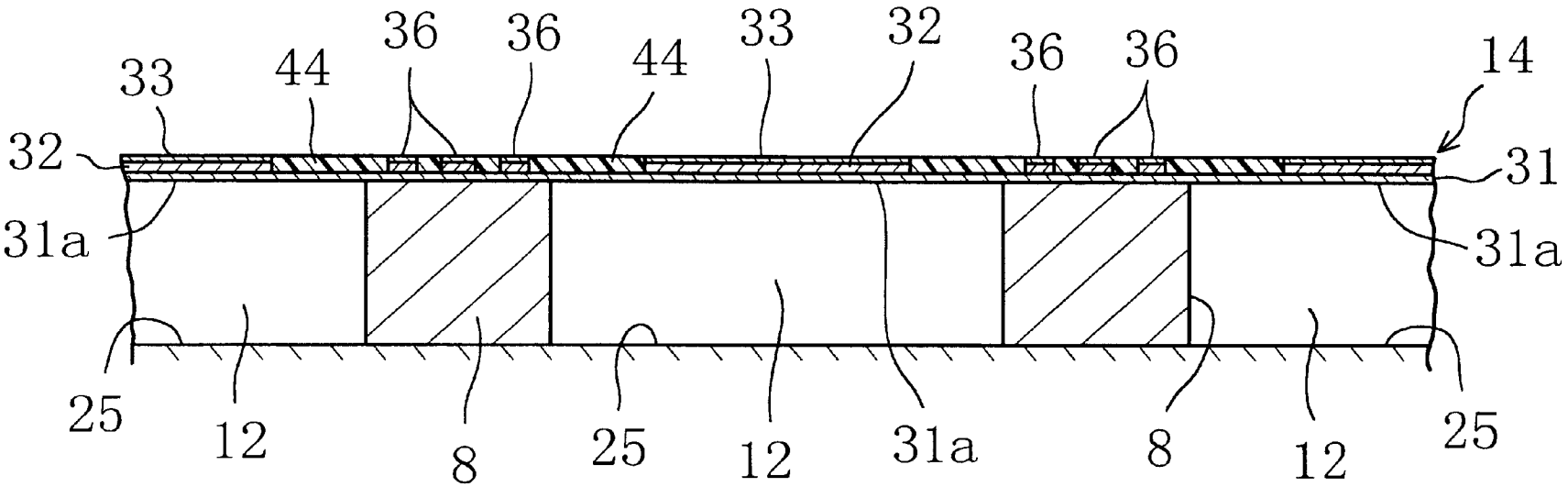
FIG. 5 is a section view (taken along the line Z—Z in FIG. 6) taken along an auxiliary scanning direction of pressure chambers of the ink jet head shown in FIG. 1.

As shown in FIG. 5, the actuator 14 comprises: a diaphragm 31 in the form of a thin film disposed as covering the pressure-chamber concave portions 25, the diaphragm 31 having deformable portions 31*a* respectively forming the pressure chambers 12; piezoelectric elements 32, each in the form of a thin film, placed on and bonded to the deformable portions 31*a* of the diaphragm 31; and individual electrodes 33, each in the form of a thin film, respectively placed on and bonded to the piezoelectric elements 32. In this embodiment, the diaphragm 31 is made of Cr or a Cr-type material and has a thickness of 1 to 5 $\mu$m. The diaphragm 31 serves as a common electrode operable for ink discharge from the pressure chambers 12. On the other hand, each piezoelectric element 32 and each individual electrode 33 are disposed for each pressure chamber 12. Each piezoelectric element 32 is made of PZT and has a thickness of 1 to 7 $\mu$m. Each individual electrode 33 is made of Pt or a Pt-type material and has a thickness of not greater than 1 $\mu$m, for example 0.1 $\mu$m.

Figure 6:
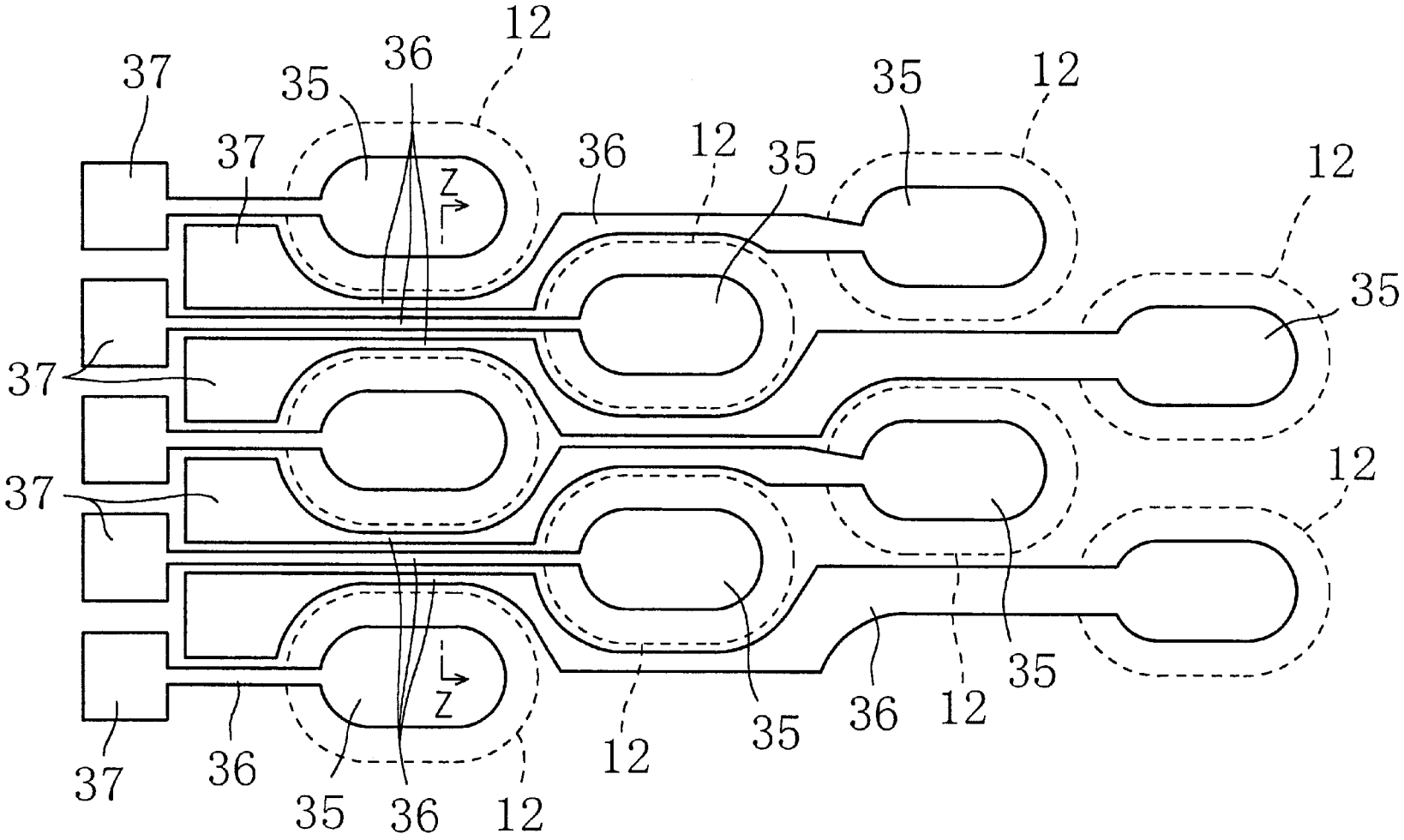
FIG. 6 is a plan view illustrating the arrangement of pressure chambers and the like of the ink jet head shown in FIG. 1.

FIG. 6 shows a specific arrangement of pressure chambers 12 and the like of the ink jet head 1. In FIG. 6, there are shown the pressure chambers 12 in the left-side four columns out of the eight columns in FIG. 2, the pressure chambers 12 being disposed such that their larger diameters L extend in the direction at aright angle to the column direction. Here, the left-end column in FIG. 6 is defined as the first column. In FIG. 6, the pressure chambers 12 in the second column are disposed at positions corresponding to the positions between the adjacent pressure chambers 12 in the first column. These positional relationships of the pressure chambers 12 in the first and second columns, are applied to the positional relationships of the pressure chambers 12 in the second and third columns, and to the positional relationships of the pressure chambers 12 in the third and fourth columns. More specifically, a number of pressure chambers 12 are arranged in a plurality of columns and disposed in zigzags such that the pressure chambers 12 in one column are positionally shifted in the column direction with respect to the pressure chambers 12 in the adjacent columns.

Moreover, no pressure chambers 12 in the four columns are arranged on straight lines in the direction at a right angle to the column direction, but the pressure chambers 12 in any of the four columns are slightly positionally shifted in the column direction with respect to the pressure chambers 12 in other columns.

Figure 2:
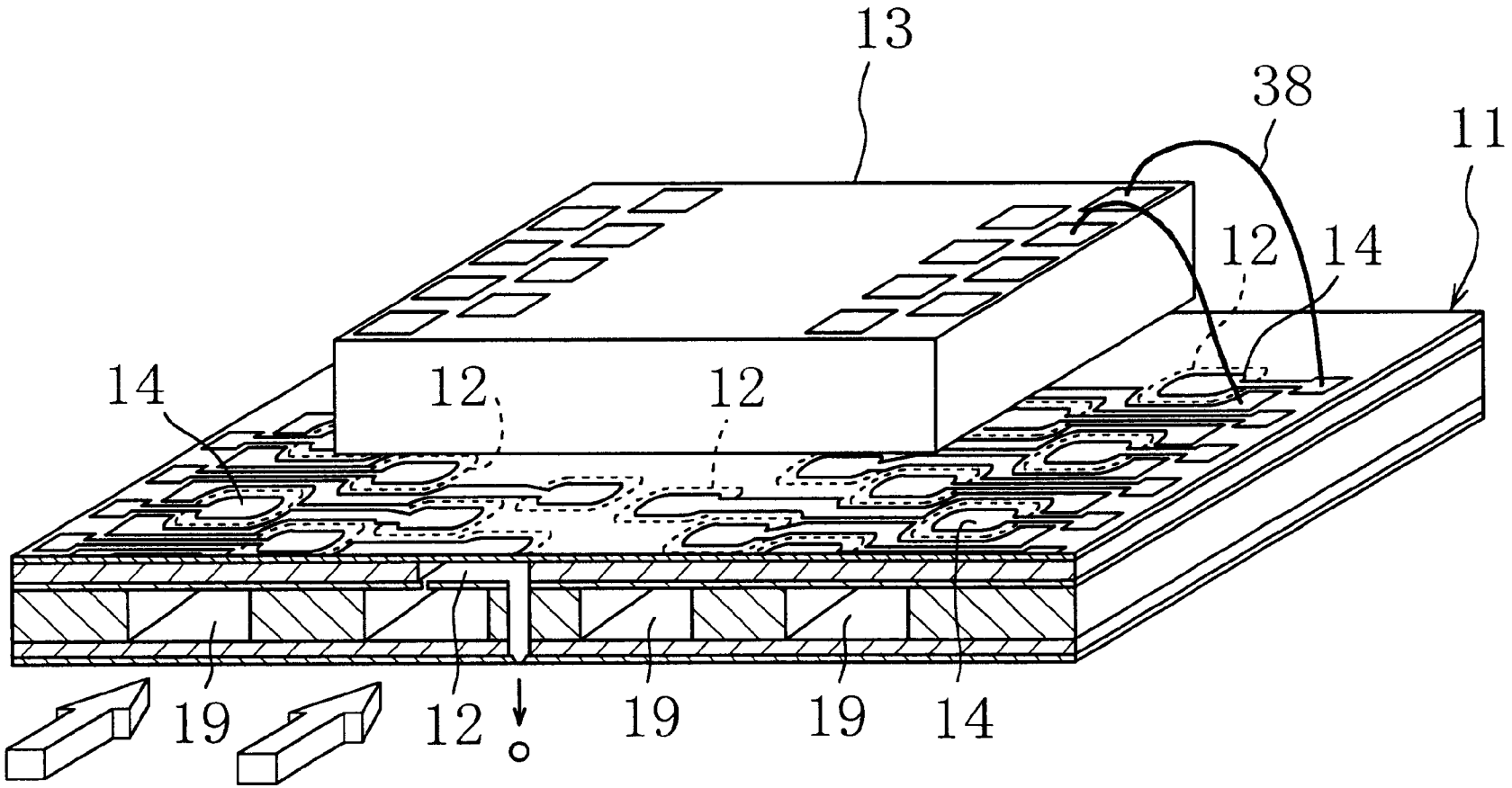
FIG. 2 is a perspective view of portions of the ink jet head shown in FIG. 1.

Not only the pressure chambers 12 in the left-side four columns shown in FIG. 6, but also the pressure chambers 12 in the right-side four columns in FIG. 2 are disposed in zigzags. That is, these pressure chambers 12 in the right-side four columns are also disposed such that no pressure chambers 12 in the four columns are arranged on straight lines in the direction at a right angle to the column direction, but the pressure chambers 12 in any of the four columns are slightly positionally shifted in the column direction with respect to the pressure chambers 12 in other columns.

The respective piezoelectric elements 32 and the respective individual electrodes 33 placed thereon for the respective pressure chambers 12, are formed in the same pattern on the surface of the diaphragm 31 to form drive portions 35, conductor portions 36, and electric contact portions 37. The drive portions 35 are formed for deforming the deformable portions 31*a* of the diaphragm 31, these drive portions 35 being formed at the deformable portions 31*a*. The conductor portions 36 extend from the drive portions 35 to the outside of the left-end pressure chamber column. The electric contact portions 37 are formed outside of the left-end pressure chamber column. In this case, the diaphragm 31 serving as a common electrode is insulated from the individual electrodes 33 by the piezoelectric elements 32. The electric contact portions 37 are respectively connected to the electrode portions (bonding pads) of the IC chip 13 by conductor lines 38 (wire bonding).

The conductor portions 36 which extend from the drive portions 35 of the pressure chambers 12 in each of the columns inside of the left-end pressure chamber column, pass between adjacent pressure chambers 12 of each of other outer column(s), these conductor portions 36 passing at the head surface side.

In the ink jet head 1 having the arrangement above-mentioned, a number of the pressure chambers 12 are disposed in a plurality of columns, and the pressure chambers 12 in adjacent columns are positioned in zigzags such that the pressure chambers 12 are arranged as densely as possible. Further, partition walls 8 are disposed for partitioning adjacent pressure chambers 12 (See FIG. 5). Those portions of the partition walls 8 at the side of the head surface, are utilized for installing the conductor portions 36. Three pressure-chamber columns are disposed inside of the left-end pressure-chamber column. Accordingly, as shown in FIG. 5, three drive conductor portions 36 pass, at the head surface side, between each adjacent pressure chambers 12 in the left-end pressure-chamber column.

Also, the pressure chambers 12 in the right-side four pressure-chamber columns have the same pattern of the piezoelectric elements 32 and the individual electrodes 33 as that shown in FIG. 6. In the right-side four pressure-chamber columns, however, the conductor portions 36 extend to the outside of the right-end pressure-chamber column and a group of electric contacts is disposed outside of the right-end pressure-chamber column.

Figure 7:
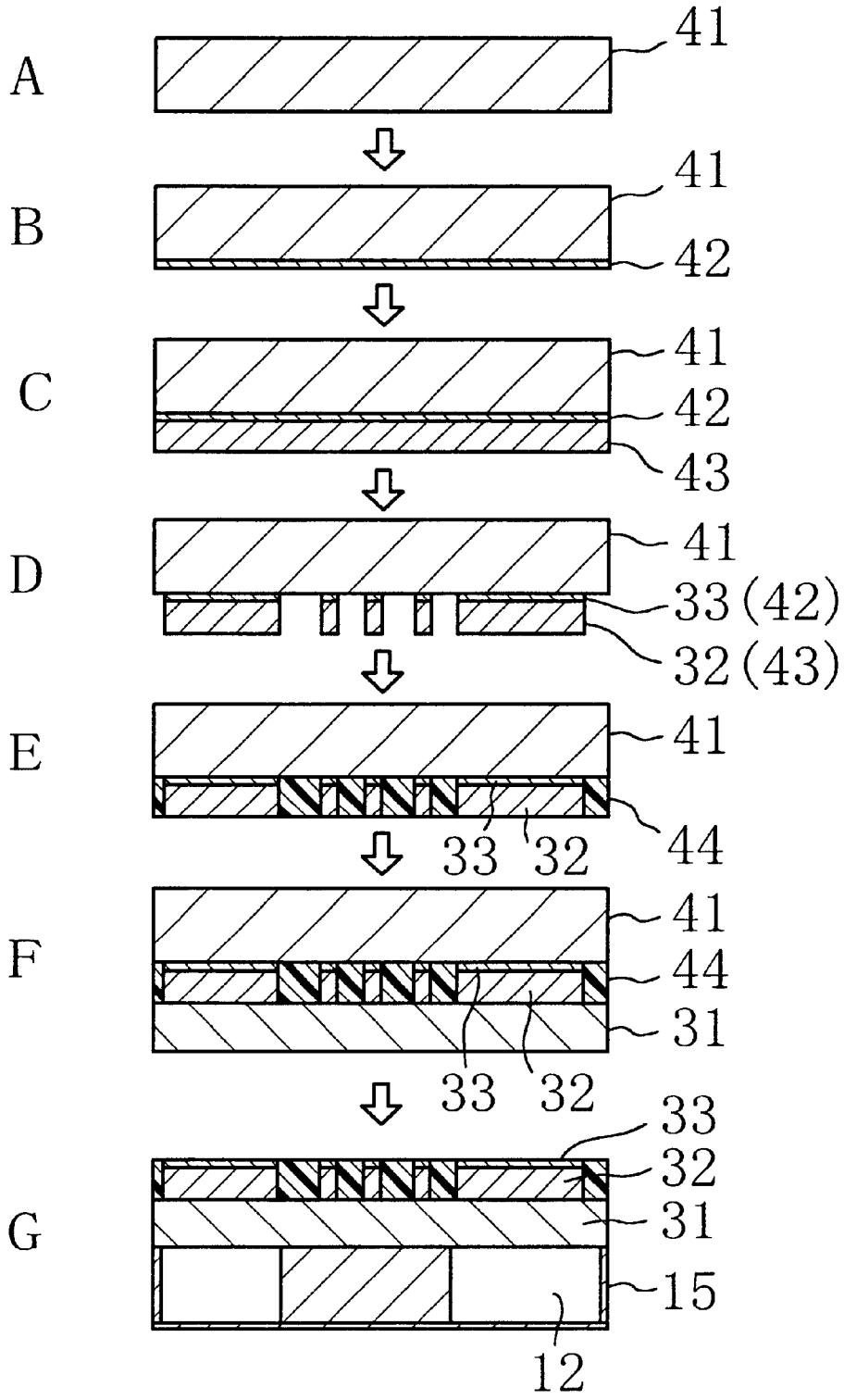
FIG. 7 is a section view illustrating the steps of a method of forming a pattern for piezoelectric elements and individual electrodes of pressure chambers of the ink jet head shown in FIG. 1.

The following description will discuss a method of forming this pattern referring to FIG. 7, which successively illustrates the respective steps of this method from the top to the bottom.

FIG. 7A shows the step of preparing a patterning substrate 41. There is used the substrate 41 having a thickness of 20 nm for example.

FIG. 7B shows the step of forming, on the surface of the substrate 41, a Pt film 42 which will result in individual electrodes. Such forming is made by sputtering. The Pt film 42 has a thickness of 0.1 $\mu$m for example.

FIG. 7C shows the step of forming, on the surface of the Pt film 42, a PZT film 43 which will result in piezoelectric elements. Such forming is made by sputtering. The PZT film 43 has a thickness of 2 to 3 $\mu$m for example.

FIG. 7D shows the step of patterning both the Pt film 42 and the PZT film 43 at the same time. This step is conducted for forming a pattern of the piezoelectric elements 32 and the individual electrodes 33. This patterning is conducted by chemical etching or ion milling. After etching, the surface is smoothened.

FIG. 7E shows a plastic coating step. At this step, the portions removed by the patterning at the step of FIG. 7D are filled with insulating members (plastics) 44 to insulate the individual electrodes 33 from one another. As the plastic, polyimide is for example used.

FIG. 7F shows the step of forming a diaphragm 31 on the surfaces of the piezoelectric elements 32, the individual electrodes 33 and the insulation members 44. Such forming is made by Cr-sputtering. The diaphragm 31 has a thickness of 2 $\mu$m for example.

FIG. 7G shows the step of bonding, to the surface of the diaphragm 31, a first plate 15 for forming pressure chambers. After this bonding, the substrate 41 is removed.

EXAMPLES

To achieve a high dot density, there were produced ink jet heads in which each diaphragm 31 had a thickness of 2 $\mu$m, in which each piezoelectric element 32 had a thickness of 3 $\mu$m, and in which the oval-shape deformable portions 31*a* were variously changed in larger and shorter diameters L, S.

Table shows the ratios L/S, the ratio A/V between the area A ($\mu m^2$)of deformable portion 31*a* and maximum discharge amount V (p1), necessary pressure chamber depth, partition wall thickness and the number of necessary pressure-chamber columns (the number of columns in zigzag arrangement).

larger; otherwise, no ink can be supplied. Thus, the depth of each pressure chamber 12 was made deeper. As the depth of each pressure chamber 12 is deeper, each pressure chamber partition wall is increased in area to lower the rigidity thereof. Accordingly, as the depth of each pressure chamber 12 was deeper, the thickness of each partition wall T was made thicker such that even though ink was discharged from a pressure chamber 12, the partition walls of this pressure chamber 12 were not bent to prevent the ink in each of the adjacent pressure chambers 12 was moved.

Using the nozzle pitch P, the shorter diameter S of each deformable portions 31*a* of the diaphragm 31 and the partition wall thickness T of pressure chamber 12, the number of required pressure-chamber columns N can be obtained from the following equation:

$$N=(S+T)\div P$$

Calculations according to this equation produced fractions below the decimal point. Thus, rounded-up numerals were actually used.

"Comparative Example" in Table shows the data obtained with an ink jet head in which the diaphragm had a thickness of 9 $\mu$m, each piezoelectric element had a thickness of 12 $\mu$m and each deformable portion (the opening of each pressure-chamber concave portion) was made in a slender rectangle shape.

It is understood from Table that the ratio A/V can be made small when the diaphragm 31 and the piezoelectric elements 32 are thin as in Examples, and that the ratio A/V becomes small particularly when the ratio L/S is in the range of 1~3. It is also understood that regardless of the magnitude of the

| Dot | Nozzle | Discharge Amount | Diaphragm | | | | Pressure Chamber | Partition Wall | Number of Pressure-Chamber Columns | |
|---|---|---|---|---|---|---|---|---|---|---|
| Density dpi | Pitch P | V Pl | S $\mu$m | L $\mu$m | L/S | A/V | Depth $\mu$m | Thickness $\mu$m | Calculated Number | Actual Number |
| 300 | 84.7 | 70 | 433 | 1300 | 3 | 8041 | 250 | 125 | 6.59 | 7 |
| 300 | 84.7 | 70 | 580 | 1160 | 2 | 9611 | 250 | 125 | 8.33 | 9 |
| 300 | 84.7 | 70 | 720 | 720 | 1 | 7406 | 250 | 125 | 9.98 | 10 |
| 600 | 42.3 | 15 | 200 | 600 | 3 | 8000 | 100 | 50 | 5.91 | 6 |
| 600 | 42.3 | 15 | 230 | 460 | 2 | 7053 | 100 | 50 | 6.61 | 7 |
| 600 | 42.3 | 15 | 320 | 320 | 1 | 6827 | 100 | 50 | 8.74 | 9 |
| 1200 | 21.2 | 5 | 110 | 330 | 3 | 7260 | 50 | 25 | 6.38 | 7 |
| 1200 | 21.2 | 5 | 140 | 280 | 2 | 7840 | 50 | 25 | 7.79 | 8 |
| 1200 | 21.2 | 5 | 180 | 180 | 1 | 6480 | 50 | 25 | 9.69 | 10 |
| Comparative Example: | | | | | | | | | | |
| Diaphragm (slender rectangle shape), 2840 $\mu$m in length, 205 $\mu$m in width, Discharge Amount V = 20 pl, A/V = 29110 | | | | | | | | | | |

In each of Examples, the nozzle pitch P was determined according to the dot density to be achieved, and the maximum discharge amount became smaller with an increase in dot density. When the maximum discharge amount is smaller, the area of each deformable portion 31*a* of the diaphragm 31 can be small. Accordingly, as the target dot density was higher, both the larger diameter L and the shorter diameter S of each deformable portion 31*a* were made smaller. However, as the ratio L/S between the larger diameter L and the shorter diameter S. three ratio values 1, 2 and 3 were used.

According to the maximum discharge amount, the pressure chamber depth was changed in order to discharge the corresponding amount of ink with good response. More specifically, when the amount of ink to be discharged is larger, the volume of each pressure chamber 12 should be target dot density, the dot densities 300~1200 dpi can actually be obtained when the number of the pressure-chamber columns is in the range of 6~10.

Further, it is understood from Table and FIG. 6 that when each deformable portion 31*a* of each diaphragm 31 is made in the form of an oval in which the ratio L/S is in the range of 1~3, the ratio A/V can be reduced as compared with the case of a deformable portion in the form of a slender rectangle, and the pressure chambers 12 can densely be disposed to reduce the ink jet head in size. In particular, when each deformable portion 31*a* is oval in shape, the pressure chambers 12 are not extensively dispersed in the main scanning direction even though the number of pressure-chamber columns is increased. Accordingly, even though the nozzles (ink discharge holes 23) are formed immediately below the pressure chambers 12, the nozzles are not extensively dispersed in the main scanning direction. This apparently facilitates a signal processing for selectively discharging ink from nozzles.

In the zigzag and multi-column arrangement of the pressure chambers 12, the partition wall portions of adjacent pressure chambers 12 are utilized as individual electrodes 33 wiring spaces. This prevents the pressure chambers 12 from being extensively dispersed in the main and auxiliary scanning directions. Further, the use of the partition wall portions as wiring spaces enables the electric contacts to be gathered outside of the pressure-chamber columns. This is advantageous in wire bonding with the IC chip 13.

The present invention can be embodied in a variety of forms without departing from the spirit and the main features thereof. Therefore, the present invention should not be construed as limited to the specific embodiments and examples above-mentioned.

For example, in the ink jet head 1 in the embodiment above-mentioned, the ink discharge holes 23 are formed immediately below the pressure chambers 12. However, the ink discharge holes of the pressure chambers 12 may be gathered and arranged in the auxiliary scanning direction, and ink discharge passages may be extended to the ink discharge holes from the pressure chambers 12.

What is claimed is:

1. In an ink jet head comprising: a head main body in which a plurality of pressure-chamber concave portions having supply ports for supplying ink and discharge ports for discharging ink; and a plate-like actuator which covers the pressure-chamber concave portions of the head main body, which forms a plurality of pressure chambers together with the pressure-chamber concave portions, and portions covering the pressure-chamber concave portions of which is deformable by field induction distortion serving as a drive source, causing ink in at least one pressure chamber to be discharged are formed, said ink jet head characterized in that:

said plurality of pressure chambers are arranged in not less than three columns;

a group of electric contacts for individual electrodes, of said actuator, respectively disposed for said pressure chambers, is disposed outside of the outermost pressure-chamber column out of said pressure-chamber columns; and a plurality of conductors for connecting, to the corresponding contacts of said group of electric contacts, the individual electrodes for the pressure chambers in the columns inside of said outermost pressure-chamber column, pass between adjacent pressure chambers in said outermost pressure-chamber column, said conductors passing at the head surface side.

2. In an ink jet head comprising: a head main body in which a plurality of pressure-chamber concave portions having supply ports for supplying ink and discharge ports for discharging ink; and a plate-like actuator which covers the pressure-chamber concave portions of the head main body, which forms a plurality of pressure chambers together with the pressure-chamber concave portions, and portions covering the pressure-chamber concave portions of which is deformable by field induction distortion serving as a drive source, causing ink in at least one pressure chamber to be discharged are formed, said ink jet head characterized in that:

said plurality of pressure chambers are arranged in a plurality of columns;

said actuator comprises: a diaphragm which covers said pressure-chamber concave portions of said head main body and which forms said pressure chambers together with said pressure-chamber concave portions; piezoelectric elements, each in the form of a thin film, respectively disposed for said pressure chambers and bonded to said diaphragm at said deformable portions thereof which form said pressure chambers, each piezoelectric elements being arranged to deform each deformable portion to discharge ink in each pressure chamber; and individual electrodes respectively disposed for said piezoelectric elements for applying a voltage thereto; and said piezoelectric elements and said individual electrodes are formed, as overlapped each other in the same pattern, on the surface of said diaphragm, thereby to form drive portions and conductor portions, said drive portions being formed, at said deformable portions, for deforming said deformable portions, said conductor portions extending from said drive portions to the outside of the outermost pressure-chamber column out of said plurality of pressure-chamber columns, and the conductor portions which extend from the drive portions of the pressure chambers in the columns inside of said outermost pressure-chamber column, passing between adjacent pressure chambers in said outermost pressure-chamber column, said conductor portions passing at the head surface side.

3. An ink jet head having a plurality of pressure chambers each including a supply port for supplying ink and a discharge port for discharging the ink, comprising:

a head main body in which a plurality of concave portions for the pressure chambers are formed;

a plate-like actuator which covers each of the concave portions of the head main body to compose the respective pressure chambers together with the respective concave portions and which is deformed by field induction distortion serving as a drive source to discharge the ink in the pressure chambers;

individual electrodes respectively provided for the pressure chambers;

an electric contact group of contacts for the respective individual electrodes; and conductors which respectively connect the individual electrodes to the corresponding contacts of the electric contact group, wherein the pressure chambers are arranged in three or more pressure-chamber columns, the electric contact group is arranged outside of an outermost pressure-chamber column out of the three or more pressure-chamber columns, and a plurality of conductors out of the conductors, which connect the individual electrodes of the pressure chambers in two or more different pressure-chamber columns inside of the outermost pressure-chamber column to the corresponding contacts of the electric contact group, pass between the adjacent pressure chambers in the outermost pressure-chamber column on an observe side of the ink jet head.

4. The ink jet head of claim 3, wherein the actuator includes deformable portions respectively composing a part of the pressure chambers and having a thickness of not exceeding 8 $\mu$m, the number of the pressure-chamber columns are in a range between 6 and 10, and when the ink jet head makes one scan in a main scanning direction, a dot density in an auxiliary scanning direction at a right angle to the main scan direction is 300 dpi or more.

5. The ink jet head of claim 4, wherein the actuator has a maximum thickness in a range between 2 and 8 $\mu$m, and a dot density is in a range between 300 and 1200 dpi.

6. The ink jet head of claim 4, wherein the actuator includes:

a diaphragm which covers the concave portions of the head main body to compose the pressure chambers together with the concave portions; and thin-film piezoelectric elements, which are respectively provided at the pressure chambers and which are respectively bonded to the deformable portions, for deforming the respective deformable portions to discharge the ink in the respective pressure chambers, the individual electrodes are respectively provided at the piezoelectric elements to apply a voltage to the respective piezoelectric elements, and a thickness of the deformable portions is in a range between 1 and 5 $\mu$m.

7. The ink jet head of claim 3, wherein each of the concave portions has an opening in an oval shape.

8. The ink jet head of claim 3, wherein the pressure chambers are arranged zigzag so that the pressure chambers in each of the pressure-chamber columns are disposed at position corresponding to positions between the adjacent pressure chambers in each of the adjacent pressure-chamber columns.

9. An ink jet head having a plurality of pressure chambers each including a supply port for supplying ink and a discharge port for discharging the ink, comprising:

a head main body in which a plurality of concave portions for the pressure chambers are formed;

a plate-like actuator which covers each of the concave portions of the head main body to compose the respective pressure chambers together with the respective concave portions and which is deformed by field induction distortion serving as a drive source to discharge the ink in the pressure chambers, wherein the pressure chambers are arranged in a plurality of pressure-chamber columns, the actuator includes:

a diaphragm which covers the concave portions of the head main body to compose the pressure chambers together with the concave portions and which includes deformable portions respectively composing a part of the pressure chambers;

thin-film piezoelectric elements, which are respectively provided at the pressure chambers and which are respectively bonded to the deformable portions, for deforming the respective deformable portions to discharge the ink in the respective pressure chambers; and individual electrodes, which are respectively provided at the piezoelectric elements, for applying a voltage to the respective piezoelectric elements, the respective piezoelectric elements and the respective individual electrodes overlap with each other in such a manner that the same pattern is formed on the surface of the diaphragm to form respective drive portions at the respective deformable portions for respectively deforming the deformable portions and conductor portions respectively extending from the respective drive portions to the outside of an outermost pressure-chamber column out of the pressure-chamber columns, and the conductor portions respectively extending from the drive portions of the pressure chambers in the pressure-chamber columns located inside of the outermost pressure-chamber column pass between the adjacent pressure chambers in the outermost pressure chamber.

10. The ink jet head of claim 9, wherein a total thickness of the respective deformable portions and the respective drive portions is not exceeding 8 $\mu$m, the number of pressure-chamber columns is in a range between 6 and 10, and when the ink jet head makes one scan in a main scanning direction, a dot density in an auxiliary scanning direction at a right angle to the main scanning direction is 300 dpi or more.

11. The ink jet head of claim 10, wherein a maximum total thickness of the respective deformable portions and the respective drive portions is in a range between 2 and 8 $\mu$m, and a dot density is in a range between 300 and 1200 dpi.

12. The ink jet head of claim 10, wherein a thickness of the deformable portions of the diaphragm is in a range between 1 and 5 $\mu$m.

13. A method for manufacturing the ink jet head of claim 9, the method comprising the steps of:

forming a film for the individual electrodes on the surface of a substrate;

forming a film for the piezoelectric elements on the surface of the film for the individual electrodes;

forming the drive portions and the conductors by patterning the film for the individual electrodes and the film for the piezoelectric elements;

forming the diaphragm which covers the surfaces of the drive portions and the conductors;

bonding a plate for forming the pressure chambers over the diaphragm; and removing the substrate.

14. The method for manufacturing an ink jet head according to claim 13, wherein the film for the individual electrodes is formed by spattering.

15. The method for manufacturing an ink jet head according to claim 13, wherein the film for the piezoelectric elements is formed by spattering.

16. The method for manufacturing an ink jet head according to claim 13, wherein the diaphragm is formed by sputtering.

17. The method for manufacturing an ink jet head of any of claims 13 through 16, wherein the patterning is conducted by chemical etching or ion milling.

18. An ink jet head having a plurality of pressure chambers each including a supply port for supplying ink and a discharge port for discharging the ink, comprising:

a head main body in which a plurality of concave portions for the pressure chambers are formed;

a plate-like actuator which covers each of the concave portions of the head main body to compose the respective pressure chambers together with the respective concave portions and which is deformed by field induction distortion serving as a drive source to discharge the ink in the pressure chambers;

individual electrodes respectively provided for the pressure chambers;

an electric contact group of contacts for the respective individual electrodes; and conductors which respectively connect the individual electrodes to the corresponding contacts of the electric contact group, wherein the pressure chambers are arranged in three or more pressure-chamber columns, and a plurality of conductors out of the conductors, which connect the respective individual electrodes for the pressure chambers in a pressure-chamber column adjacent to an outermost pressure column out of the pressure-chamber columns to the corresponding contacts of the electric contact group, pass between the adjacent pressure chambers in the outermost pressure column.

19. An ink jet printer, comprising:

the ink jet head of any of claims 3 through 8; and a recording paper delivery device for delivering recording paper.

* * * * *

UNITED STATES PATENT AND TRADEMARK OFFICE

CERTIFICATE OF CORRECTION

PATENT NO. : 6,471,342 B1
DATED : October 29, 2002
INVENTOR(S) : Hideaki Horio et al.

It is certified that error appears in the above-identified patent and that said Letters Patent is hereby corrected as shown below:

Column 16,
Line 8, change "the ink jet head of any of claims 3 through 8; and" to -- the ink jet head of any of claims 3 through 12 and 18; and --

Signed and Sealed this

Fifth Day of August, 2003

JAMES E. ROGAN
*Director of the United States Patent and Trademark Office*